US007062854B2

(12) United States Patent
Greene et al.

(10) Patent No.: US 7,062,854 B2
(45) Date of Patent: Jun. 20, 2006

(54) APPARATUS AND METHOD FOR ASSEMBLING A GATE

(75) Inventors: David Allen Greene, Uniondale, NY (US); Anthony Mark Fabella, Centereach, NY (US); Herbert Rosenthal, Boynton Beach, FL (US)

(73) Assignee: Woody's Lumber, Inc., Farmingdale, NY (US)

( * ) Notice: Subject to any disclaimer, the term of this patent is extended or adjusted under 35 U.S.C. 154(b) by 484 days.

(21) Appl. No.: 10/260,191

(22) Filed: Sep. 30, 2002

(65) Prior Publication Data

US 2004/0060159 A1 Apr. 1, 2004

(51) Int. Cl.
*B21D 47/00* (2006.01)

(52) U.S. Cl. ..... 29/897.312; 29/897.31; 29/458

(58) Field of Classification Search ..... 29/458, 29/466, 468, 897.31, 897.312; 256/65.11
See application file for complete search history.

(56) References Cited

U.S. PATENT DOCUMENTS 4,007,919 A 2/1977 Totten
4,609,185 A 9/1986 Prater et al.
4,722,514 A 2/1988 Pettit
5,713,171 A 2/1998 Andres
6,010,117 A 1/2000 Doxey
6,131,888 A 10/2000 Brown
6,158,101 A * 12/2000 Ellis et al. ..... 29/281.5
6,173,944 B1 1/2001 McCarthy
6,176,043 B1 1/2001 Gibbs
6,299,142 B1 10/2001 Chancy et al.
6,398,193 B1 6/2002 DeSouza
6,460,829 B1 * 10/2002 Forbis et al. ..... 256/24

* cited by examiner

*Primary Examiner*—Marc Jimenez
(74) *Attorney, Agent, or Firm*—Ronald V. Davidge

(57) ABSTRACT

A clamping fixture for use in the assembly of a gate comprised of a number of plastic members includes a flat stationary clamping surface attached to a stationary frame and a flat moving clamping surface extending parallel to the flat clamping surface and driven toward the flat clamping surface by an actuator, so that the plastic members, assembled in the configuration of the gate, are clamped and held between the clamping surfaces. Preferably, the actuator, which includes one or more pneumatic cylinders, is adjustable along the frame to provide for the assembly of gates having different widths. Preferably, the clamping fixture additionally includes a stationary flat guiding strip extending perpendicularly from an end of the flat stationary clamping surface toward the flat moving clamping surface.

11 Claims, 4 Drawing Sheets

APPARATUS AND METHOD FOR ASSEMBLING A GATE

BACKGROUND OF THE INVENTION

1. Field of the Invention

This invention relates to an apparatus and method for assembling a gate from prefabricated materials, and, more particularly, to such a method in which dimensions of the prefabricated materials are used to establish the height and width of a gate assembled as it is held in a square condition within the apparatus.

2. Summary of the Background Art

The patent literature includes describes components and methods for constructing plastic gates. For example, U.S. Pat. No. 6,131,888 describes a polyvinyl chloride (PVC) elbow connector for joining rail and post members of PVD gate structures, a customizable PVC gate structure incorporating such an elbow connector, and a method of constructing PVC gate structures. U.S. Pat. No. 6,176,043 describes a gate framing system for a PVC gate, with the gate including first and second spaced vertical PVC frame members connected at their upper and lower ends to a pair of spaced horizontal PVC frame members. The gate framing system includes a pair of spaced metallic framing brackets mounted at each corner of the PVC gate, with the pairs of framing brackets being connected to each other in a manner to hold the PVC gate in compression between the brackets at each corner thereof.

A number of other patents describe plastic fence construction details. For example, U.S. Pat. No. 4,007,919 describes a fence structure in which the rails are hollow members having a generally rectangular cross-sectional configuration, with special features of the hollow rail including rigid foam plastic filling its interior and intermitting tongue and groove means. U.S. Pat. No. 4,722,514 describes a rail and post fence structure having spaced hollow plastic posts with vertically spaced holes in the posts for receiving rails with a friction fit. The rails have vertical rungs, slats, or both, that are received between the rails, also with a friction fit. U.S. Pat. No. 5,713,171 describes a railing assembly for use in association with a deck. The railing includes at least one plastic post cover and at least one rail. U.S. Pat. No. 6,173,944 describes a fence section including at least two elongated parallel hollow plastic fence rails having a series of registering apertures in opposing walls thereof to provide a series of picket receiving passages therethrough. U.S. Pat. No. 6,299,142 describes horizontally spaced vertical posts that each include a square tubular extruded plastic sleeve enclosing a square tubular metal reinforcing post. U.S. Pat. No. 6,398,193 describes a fence unit extending between vertical posts, formed using extruded plastic top, middle, and bottom rails resting on hangers attached to the posts.

Plastic fence structures typically include openings that are selectively closed by gates, with such opening varying in width due to differences in the requirements for their use, due to the width of walkways extending through the gates, and due to various aesthetic considerations. Such a gate is typically made by assembling a number of elongated members that must be aligned to form a rectangular gate, and that must be held in alignment during a fastening process including the use of adhesives and/or mechanical fasteners. What is needed is a fixture for assisting in such alignment and holding the members in proper alignment as long as needed.

SUMMARY OF THE INVENTION

According to a first aspect of the invention, a clamping fixture for use in the assembly of a gate from prefabricated members is provided, with the dimensions of the prefabricated members determining the height and width of the gate as they are assembled and held together within the clamping fixture. The clamping fixture is useful in holding these members together so that adhesive bonding and screw fastening can occur in a satisfactory and repeatable manner and so that square conditions are automatically achieved between adjacent sides and ends of the gate. The clamping fixture includes a stationary frame, a stationary clamping structure having a flat stationary clamping surface attached to the frame, a moving clamping structure, including a flat moving clamping surface disposed parallel to the flat stationary clamping surface, slidably mounted to move along the stationary frame toward and away from the stationary clamping structure, and an actuator mechanism sliding the moving clamping structure between an open position, allowing the various prefabricated members to be assembled into the gate, and a closed position, in which the prefabricated members are held together in the configuration of the completed gate.

Preferably, the clamping fixture also includes an actuator slidably mounted on the stationary frame, with the actuator being moved among a number of stopping positions, in which it is held for the assembly of a gate having a particular width, and a flat stationary alignment surface extending perpendicularly from an end of the stationary clamping surface and perpendicular to the flat stationary clamping surface.

According to another aspect of the invention, a method is provided for assembling a gate from a plurality of members. The method includes forming an assembly of the members in a configuration of the gate, to rest in a clamping fixture between a flat stationary clamping surface and a flat moving clamping surface, wherein the clamping surfaces are disposed parallel to one another and spaced apart from the assembly of the members. The method additionally includes driving the flat moving clamping surface toward the flat stationary clamping surface to clamp the assembly of the members between the flat moving clamping surface and the stationary clamping surface. The method further includes exerting a clamping force on the assembly of the members between the moving clamping surface and the stationary clamping surface during attachment of members within the plurality of members to one another. The method additionally includes moving the flat moving clamping surface away from the flat stationary clamping surface. The method furthermore includes removing the assembly of the members from the clamping fixture.

Figure 1:
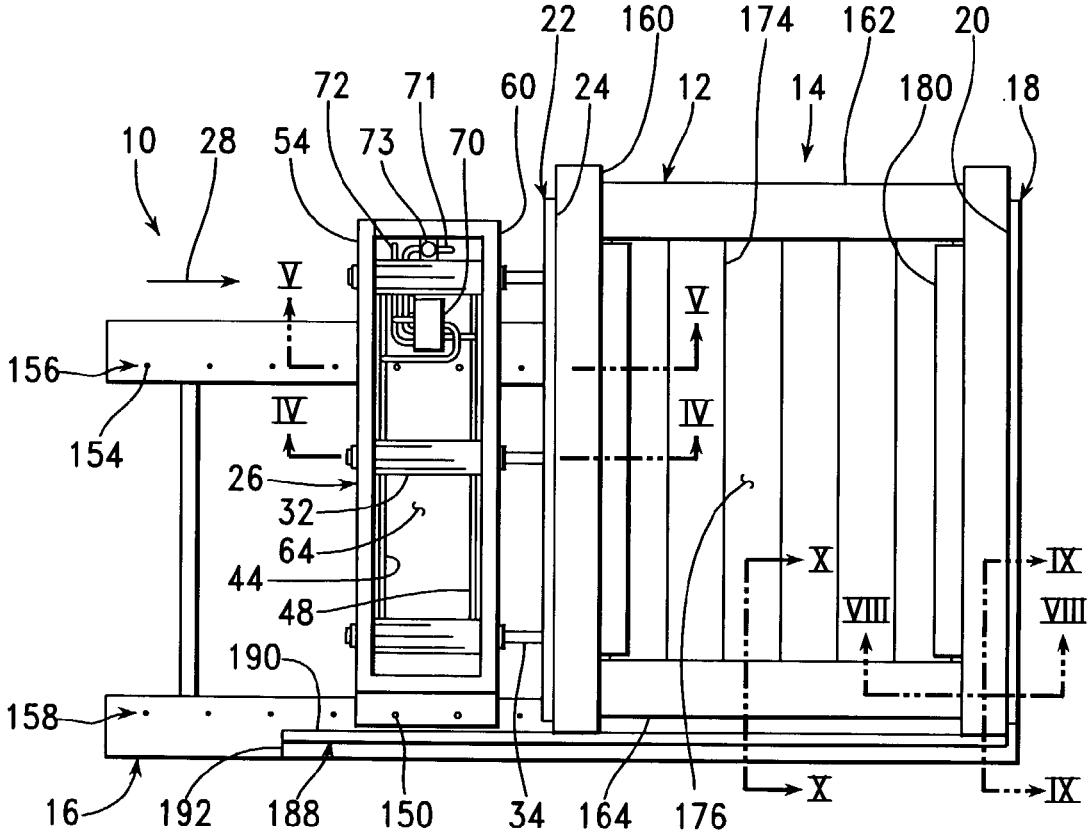
FIG. 1 is a plan view of a clamping fixture built in accordance with the present invention, holding an assembled gate in the manner provided by the present invention.
Figure 5:
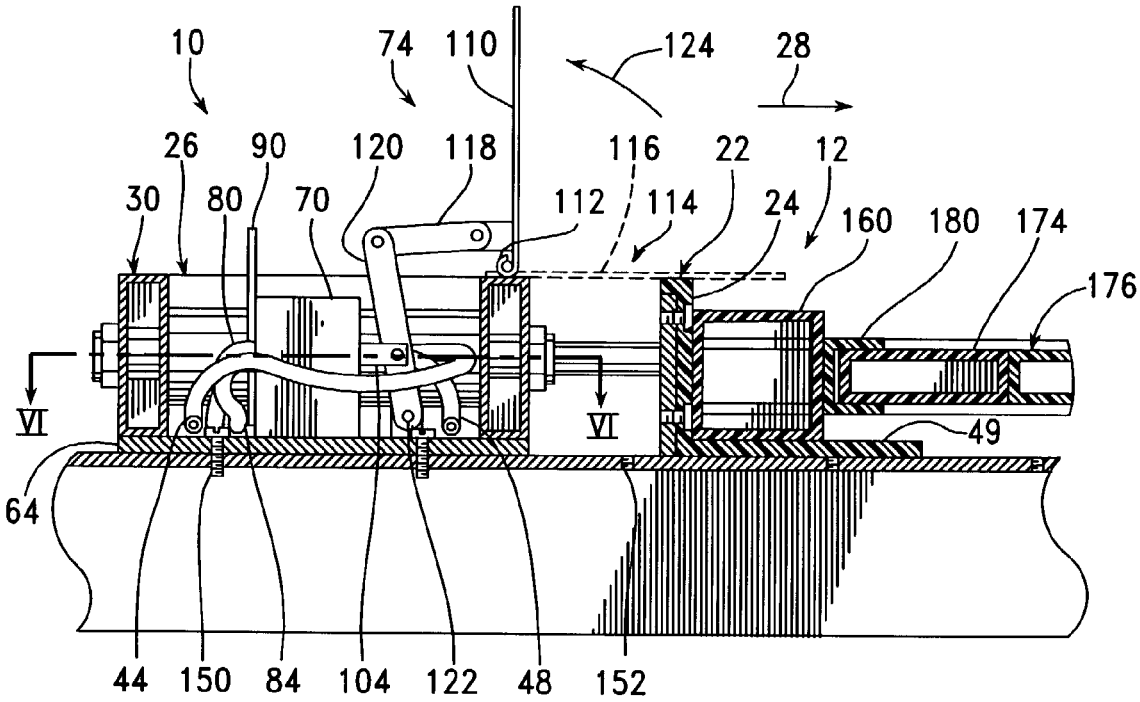
FIG. 5 is a fragmentary cross-sectional elevation of the clamping fixture of FIG. 1, holding the assembled gate thereof, taken as indicated by section lines V—V in FIG. 1 to show a valve in the clamping fixture and a first version of an optional interlock mechanism.
Figure 6:
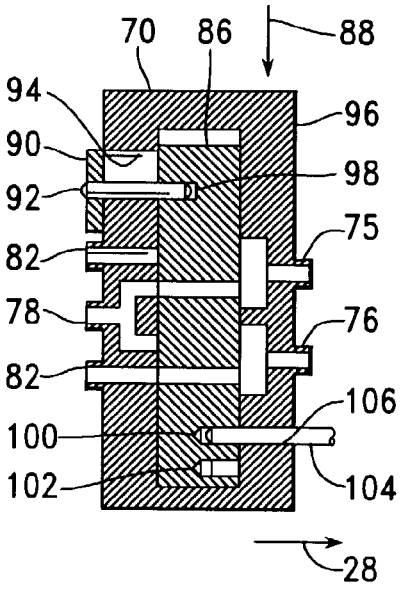
Figure 7:
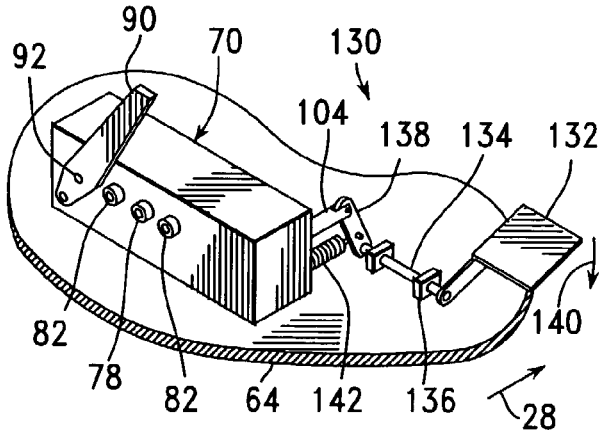
Figure 8:
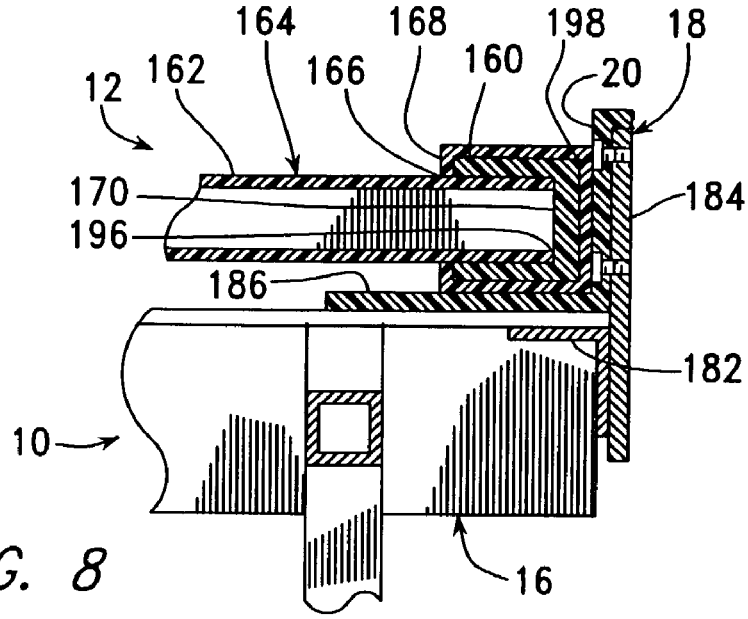
Figure 9:
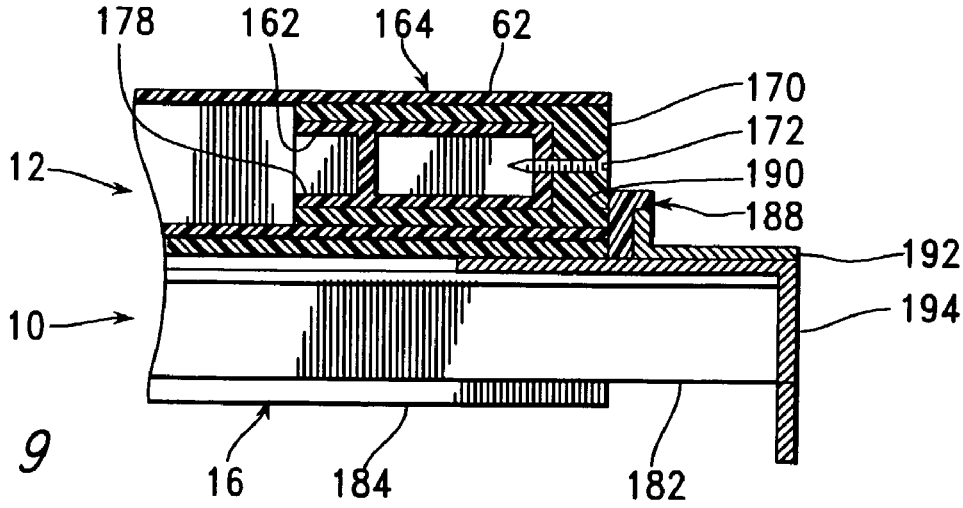
Figure 10:
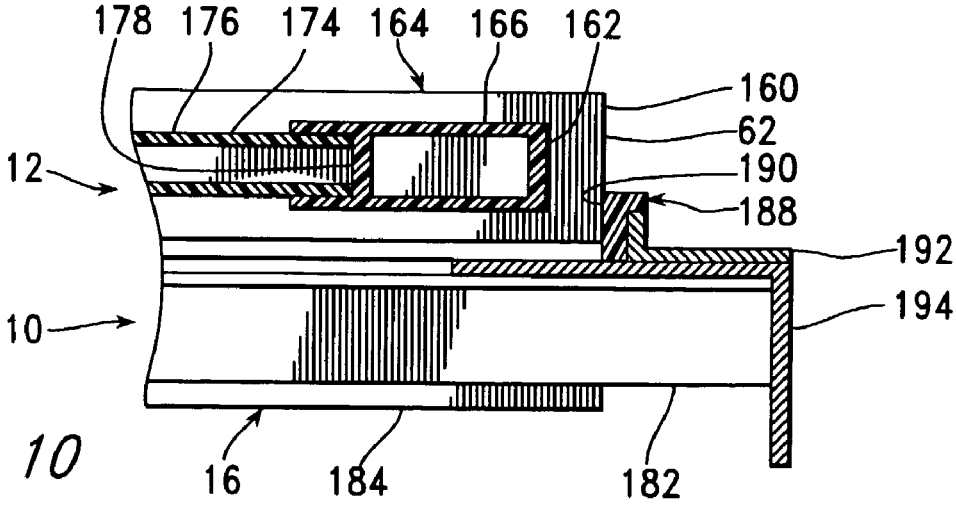

FIG. 6 is a cross-sectional plan view of the valve of FIG. 5, taken as indicated by section lines VI—VI therein;

FIG. 7 is a perspective view of the valve of FIG. 5, additionally showing a second version of an optional interlock mechanism;

FIG. 8 is a fragmentary cross-sectional elevation of the clamping fixture of FIG. 1, holding the assembled gate thereof, taken as indicated by section lines VIII—VIII in FIG. 1 to show the construction of corners in a generally rectangular frame portion of the gate;

FIG. 9 is a fragmentary cross-sectional elevation of the clamping fixture of FIG. 1, holding the assembled gate thereof, taken as indicated by section lines IX—IX in FIG. 1 to further show the construction of corners in a generally rectangular frame portion of the gate; and FIG. 10 is a fragmentary cross-sectional elevation of the clamping fixture of FIG. 1, holding the assembled gate thereof, taken as indicated by section lines X—X in FIG. 1 to show the construction of a panel portion of the gate.

DETAILED DESCRIPTION OF THE INVENTION

Figure 2:
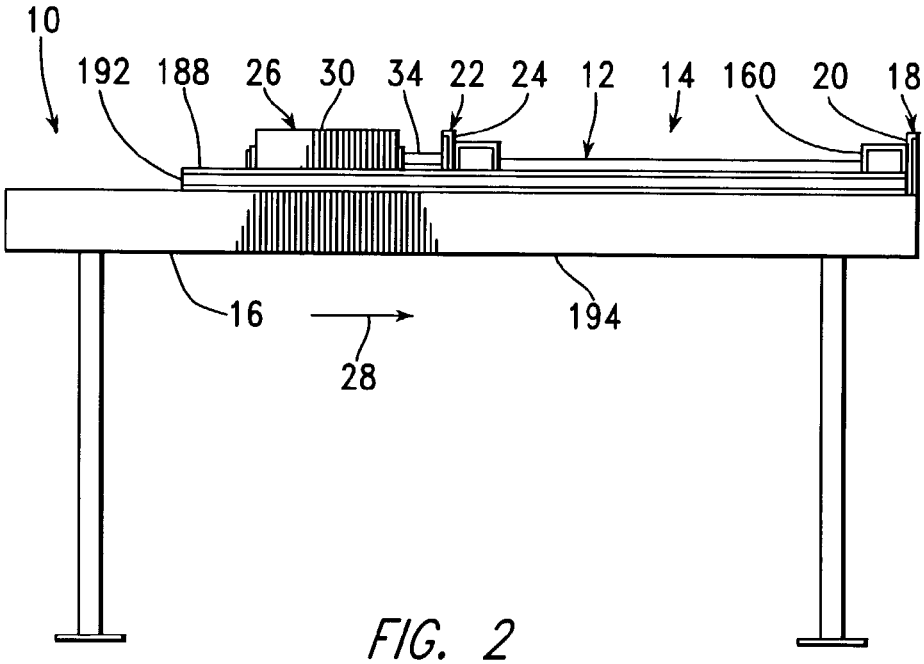
FIG. 2 is a right elevation of the clamping fixture of FIG. 1 holding the assembled gate thereof.
Figure 3:
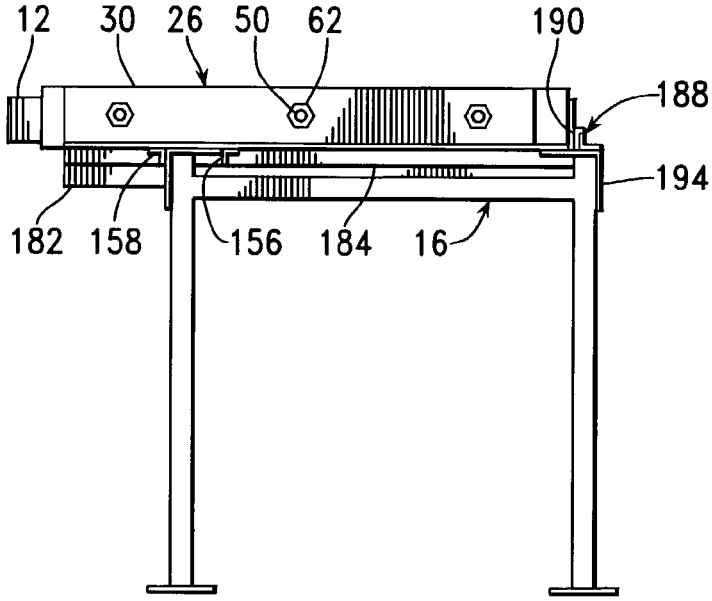
FIG. 3 is a front elevation of the clamping fixture of FIG. 1, holding the assembled gate thereof.

FIGS. 1–3 are views of a clamping fixture 10 holding a gate 12 assembled from prefabricated members, generally indicated as 14, which, upon being assembled and held within the clamping fixture 10, determine the height and width of the finished gate 12, with FIG. 1 being a plan view, while FIG. 2 is a right elevation, and while FIG. 3 is a front elevation. The members 14 are preferably composed of a thermoplastic material, such as polyvinyl chloride (PVC). The clamping fixture 10 includes a stationary frame 16, a stationary clamping structure 18 having a flat stationary clamping surface 20 attached to the stationary frame 16, and a moving clamping structure 22 including a flat moving clamping surface 24, slidably mounted to the frame 16 by means of an actuator 26 to move in the clamping direction of arrow 28 and opposite this direction. In a preferred version of the invention, the actuator 26 includes an actuator frame 30 and three pneumatic cylinders 32, each of which moves a rod 34 attached to the moving clamping structure 22.

Figure 4:
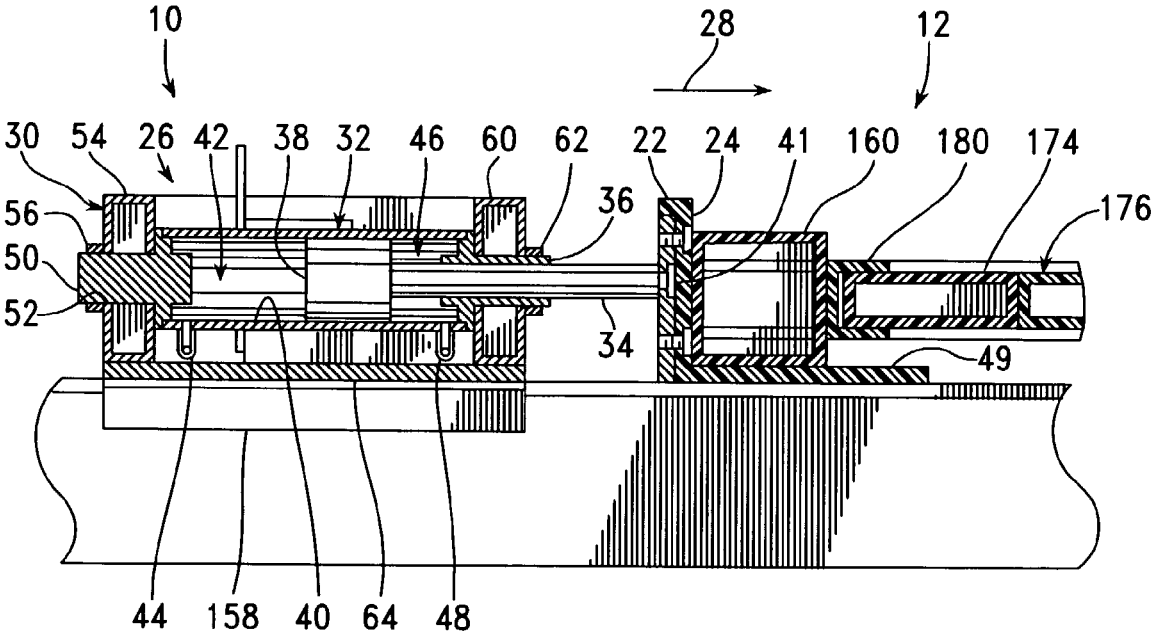
FIG. 4 is a c a pneumatic cylinder in the clamping fixture.

FIG. 4 is a fragmentary vertical cross-sectional view of the clamping fixture 10, taken as indicated by section lines IV—IV in FIG. 1 to show the internal structure of a pneumatic cylinder 32. The rod 34, which slides within a bushing structure 36 of the pneumatic cylinder 32, is attached to a piston 38 sliding within the cylindrical chamber 40 of the pneumatic cylinder 32. The rod 34 is also attached to the moving clamping structure 22 by means of a screw 41. A first end 42 of the chamber 40 within the pneumatic cylinder 32 is in fluid communication with a first air line 44, while a second end 46 of the chamber 40 is in fluid communication with a second air line 48. During operation of the clamping fixture, the moving clamping structure 22 is moved in the direction of arrow 28, and a clamping force is maintained on the assembled gate 24, by applying compressed air to the first end 42 of the chamber 40 while the second end 46 is exhausted to the atmosphere. The moving clamping structure 22 is moved opposite the direction of arrow 28, releasing the assembled gate 24, by applying compressed air to the second end 46 of the chamber 40 while the first end 42 is exhausted to the atmosphere. The moving clamping structure 22 provides a flat moving clamping surface 24 exerting a clamping force on the gate 12 and also provides a flat, upward-facing moving support surface 49, extending toward the moving clamping structure 22, upon which the assembled gate 12 rests.

A cylinder end portion 50 extends through a hole 52 in a first frame member 54 of the actuator frame 30, being held in place by a nut 56, while the bushing structure 36 extends through a hole 58 in a second frame member 60 of the actuator frame 30, to be held in place by a nut 62. The actuator frame 30 also includes an actuator plate 64 fastened to extend under the frame members 54, 60. The pneumatic cylinder 32 also includes conventional seals preventing air leakage around the piston 38 between the ends 42, 46 of the chamber 40 and along the rod 34 through the bushing structure 36.

Referring to FIG. 1, the air lines 44, 48 extending to the pneumatic cylinders 32 are selectively connected by a valve 70 to a source of compressed air (not shown) through an input air line 71 and to the atmosphere through an exhaust air line 72. The source of compressed air is, for example, a compressor dedicated for use with the fixture 10, or a shop air line providing compressed air for many uses. Preferably, the valve 70 is connected to the input air line 71 through a regulator 73 that can be adjusted to control the pressure of the air introduced into the valve 70 and hence to control the force exerted b the pneumatic cylinders 32. Thus, the regulator 73 can be used to advantage in adjusting the clamping force if different types of gates 12 are to be assembled using the fixture 10, with such different types of gates requiring different levels of clamping pressure.

While three pneumatic cylinders 32 are shown in the examples of the drawings, it is understood that as few as one such cylinder of adequate capacity may be used, being centrally located within the actuator 26. The use of three cylinders 32 provides an advantage of spreading the clamping force provided by the cylinders 32 along the length of the flat moving clamping surface 24 without requiring greater stiffness within the moving clamping structure 22. In any case, sufficient flexibility in this structure 22 and in its attachment to the rods 34 should be provided to allow the development of similar clamping forces along the length of the flat moving clamping surface 24 despite expected variations in the dimensions of the members 14 forming the gate 12 from one end of the gate 12 to the other, in a direction perpendicular to that of arrow 28.

FIGS. 5 and 6 are cross-sectional elevations of the clamping fixture 10, showing a valve 70 directing compressed air to the pneumatic cylinders 32 (shown in FIG. 1), with FIG. 5 being taken as indicated by section lines V—V in FIG. 1 to show a valve 70, and with FIG. 6 being taken as indicated by section lines VI—VI in FIG. 5.

In accordance with one embodiment of the invention, the clamping fixture 10 additionally includes an interlock mechanism for preventing movement of the moving clamping structure 22 under a condition determined to present a possible danger that an operator may be exposed to a pinching action due to such movement. Thus, FIG. 5 additionally shows a first version of such an interlock mechanism, generally indicated as 74.

The valve 70 includes a first output port 75, connected to the first air line 44, and a second output port 76 connected to the second air line 48. The valve 70 also includes an input port 78, connected by an input air line 80 to a source of compressed air, and a pair of exhaust ports 82, each of which exhaust air into the atmosphere through an exhaust line 84. Within the valve 70, a slider 86 is moved in the direction of arrow 88 and opposite thereto by means of a manually pivoted handle 90, to selectively connect the input port 78 and the exhaust ports 82 with the output ports 75, 76. The slider 86 and the handle 90 are connected by a pin 92 fastened to the handle 90 and extending through a horizontal slot 94 in the housing 96 of the valve 70 into a vertical slot 98 within the slider 86. When the slider 86 is in the position shown in FIG. 6, the first output port 75 is connected to compressed air through the input port 78, and the second output port 76 is connected to the atmosphere through one of the exhaust ports 82, so that the moving clamping structure 22 is held in a closed position, being extended in the direction of arrow 28 against the gate 12 as shown in FIG. 4. When the slider is moved opposite the direction of arrow 88, the first output port 75 is connected to the atmosphere through one of the exhaust ports 82, and the second output port 76 is connected to compressed air through the input port 78, so that the moving clamping structure 22 is moved opposite the direction of arrow 28, being opened so that the moving clamping surface 24 is spaced away from the gate 12.

The slider 86 is understood to be an example of a valve structure, which may alternately be moved between positions in which a compressed air source and an exhaust line are selectively connected to air lines.

In an embodiment of the invention incorporating an interlock mechanism, the slider 86 is extended, as shown in the example of FIG. 6, to include a first locking cavity 100 and a second locking cavity 102, in which an interposing rod 104 is inserted through a hole 106 in the valve housing 96. As shown in FIG. 5, the first version 74 of such an interlock mechanism includes a guard plate 110 pivotally mounted on the second frame member 60 of the actuator frame 30 by means of a hinge 112. With the guard plate 110 in the open position shown, access is provided to the gate 12 in its unassembled and assembled conditions for the performance of various manual assembly steps, but movement of the moving clamping structure 22 may expose an operator to pinching conditions within an area 114 through which the moving clamping structure 24 moves. With the guard plate 110 in the closed position indicated by dashed lines 116, access to this area 114 is physically blocked, but some steps required in the assembly of the gate 12 may become difficult. Therefore, the guard plate 110 and the interposing rod 104 are connected through a link 118 and a crank 120, which is pivoted at a pin 122.

As the guard plate 110 is pivoted open, in the direction of arrow 124, the resulting movement of crank 120 drives the interposing rod 104 opposite the direction of arrow 28, into the cavity 100, 102 that is aligned with this rod 104 by the position of the slider 86 within the valve 70. Thus, after the guard plate 110 is pivoted open, the presence of the interposing rod 104 within one of the cavities 100, 102 prevents the movement of the slider 86. Thus, after the guard plate 110 is pivoted open, the presence of the interposing rod 104 within one of the cavities 100, 102 prevents the movement of the slider 86 within the valve 70, so that the moving clamping structure 22 cannot be moved by redirecting compressed air into the pneumatic cylinders 32.

On the other hand, as the guard plate 110 is pivoted into a closed position, opposite the direction of arrow of arrow 124, the movement of crank 120 pulls the interposing rod 104 in the direction of arrow 28, moving the tip of the rod 104 out of the cavity 100, 102, so that the slider 86 can be freely moved to move the moving clamping structure 22 by redirecting compressed air into the pneumatic cylinders 32.

While the guard plate 110 is shown as an individual pivoted structure, it is understood that this single structure may be replaced by two or more structures movable to cover different areas in which movement occurs with the moving clamping structure 22.

FIG. 7 is a perspective view of a second version of an interlock mechanism, generally indicated as 130, which relies on a determination that the operator has one hand on the pivoted handle 90 of the valve 70 and the other hand on a handle 132, instead of on the closure of a guard plate, such as the guard plate 110. The handle 132 is attached to a shaft 134, which is pivotally supported by bearing blocks 136 extending upward from the frame plate 64, and which is in turn attached to a crank 134. The crank 134 is connected to the interposing rod 104, so that, when the handle 132 is depressed, in the direction of arrow 140, the interposing rod 104 is pulled in the direction of arrow 23. This movement pulls the tip of the interposing rod 104 out of one of the cavities 100, 102 in the slider 86 within the valve 70, releasing the slider 86 to be moved by pivoting the handle 90. On the other hand, when an attempt is made to move the handle 90 without depressing the handle 132, the tip of the interposing rod 104 is held in one of the cavities 100, 102 within the slider 86 by an extension spring 104 stretched between the valve 70 and the crank 134. In this way, movement of the slider 86 and of the crank 90 is prevented without simultaneous depression of the handle 132, requiring the operator to simultaneously use both hands.

Preferably, the actuator 26 is additionally movable in and opposite the direction of arrow 28 between a number of actuator positions, each of which is used in the assembly of a gate 12 having a different width. For example, referring to FIGS. 1 and 5, the actuator 26 is held in place on the stationary frame 16 by means of several attachment fasteners 150 extending through attachment holes 152 within the actuator plate 64 and into holes 154 extending along a first line 156 and a second line 158 within the stationary frame 16. These holes 154 are spaced apart in the direction of arrow 28 to define a number of positions in which the actuator 26 may be positioned to aid in the assembly of gates 12 having various different widths. The attachment fasteners 150 may be screws engaging threads within the holes 154. Alternately, a number of attachment methods well known to those skilled in the art of designing mechanical hardware may be used, with such methods including the use of quarter-turn fasteners and various types of pins that can be pushed into place.

Referring to FIGS. 3 and 4, the actuator 26 preferably also includes guiding surfaces 156 that constrain the actuator 26 to slide along the stationary frame 16 in, and opposite to, the direction of arrow 28, which is the direction in which the moving clamping structure 22 moves to provide a clamping force against the gate 12. In the example of the figures, these guiding surfaces 156 are formed by a pair of angle members 158 extending downward from the plate 62 of the actuator frame 30.

Referring again to FIG. 1, the gate 12 is preferably assembled from a number of elongated thermoplastic members 14, composed, for example of PVC, including a post 160 extending along each of the left and right edges of the gate 12 and a pair of rails 162 extending between the posts 160 to form a generally rectangular frame 164.

While the preceding discussion has described methods for preventing the movement of an internal valve structure, i.e. the slider 85 directly by means of an interposing shaft 104, it is understood that the same result can alternately be obtained using a mechanism external to the valve 104 to selectively block movement of the handle 90.

FIGS. 8 and 9 are fragmentary cross-sectional elevations of the clamping fixture 10 holding the assembled gate 12, taken as indicated by section lines VIII—VIII and IX—IX in FIG. 1, respectively, to show the construction of the corners of the generally rectangular frame 164 formed by the posts 160 and the rails 162. Each of the posts 160 is formed, for example, by cutting an appropriate length of material from an extruded hollow thermoplastic structure and by cutting a pair of apertures 166 in a wall 168 of the structure to accept the ends of a pair of rails 162. Each of the rails 162 is formed, for example, by cutting an appropriate length of material from an extruded hollow thermoplastic structure. Preferably, a collar 170 extends around each end of each of the rails 162 within a corresponding end of a post 160, filling a space therein, with the collar 170 being adhesively attached to both the rail 162 and the post 160, and with the collar 170 additionally being attached to the rail 162 at each end by one or more screws 172.

FIG. 10 is a fragmentary cross-sectional elevation of the clamping fixture 10 holding the assembled gate 12, taken as indicated by section lines X—X in FIG. 1 to show how the ends of slats 174, forming a panel 176 within the frame 164, are held in place within the rails 162. Each of the rails 162 includes a slat-receiving trough 178 extending within the gate 12 to hold the ends of a number of the slats 174.

Referring again to FIGS. 1 and 4, each of the slats 174 is formed, for example, by cutting a suitable length of material from an extruded thermoplastic structure. The gate 12 may additionally include a channel 180, similarly formed by cutting a suitable length of material from an extruded thermoplastic structure, extending along each side of the panel 176 to fill gaps between the outermost slats 174 of the panel 176 and the adjacent posts 160.

FIG. 8 additionally shows the stationary clamping structure 18, which is attached to the stationary frame 16 to provide a flat stationary clamping surface 20. In the example of FIG. 8, the frame 16 includes an angle member 182, to which a plate 184 forming part of the stationary clamping structure 18 is fastened. The stationary clamping structure 18 also provides a flat, upward-facing stationary support surface 186, extending toward the moving clamping structure 22, upon which the assembled gate 12 rests.

Referring to FIGS. 1 and 9, the clamping fixture 10 preferably additionally includes a stationary guiding structure 188, providing a flat stationary guiding surface 190 extending from and end of the flat stationary clamping surface 20, perpendicular to the flat stationary clamping surface 20, toward the flat moving clamping surface 24. When the gate 12 is assembled and held with the ends of posts 160 against the flat stationary guiding surface 190, it is known to be in a square condition, instead of in a skewed, or rhombic, condition. The flat stationary guiding structure 188 includes, for example, an "L"-shaped member 192 fastened to a frame member 194 forming part of the stationary frame 16. Preferably, the stationary guiding structure 188 is low enough to allow the installation of screws 172 above this structure 188 with the members 14 forming the gate 12 in place within the clamping fixture 10.

The overall dimensions of the gate 12 are preferably determined by the dimensions of the prefabricated members 14, with the width of the gate 12, i.e. the dimension of the gate i2 held within the clamping fixture 10 in the direction of arrow 28, being established, for example, by the length of the rails and by dimensions of the collars and of the posts. The height of the gate 12, in the direction perpendicular to its width, is established, for example, by the lengths of the posts. With the width of the gate thus being determined by the prefabricated members 14, the clamping force provided within the clamping fixture 10 is used to surfaces of the members together during an attachment process, which may include both adhesive attachment and attachment by fasteners. For example, referring to FIG. 8, these clamping forces hold adjacent surfaces together at first interfaces 196 between the ends of the rails 162 and the collars 170, and additionally hold adjacent surfaces together at second interfaces 198 between the collars 170 and the posts 160. The perpendicularity between adjacent edges of the gate 12 is established by aligning adjacent corners of the gate, formed by ends of posts 160, against the flat guiding surface 190 and by controlling the dimensions of members 14 so that the opposite sides of the gate are identical in length.

In accordance with a preferred version of the invention, a process for assembling the gate 12 from the members 14 includes a first step of forming an assembly of the members 14 in the configuration of the gate 12 to rest in the clamping fixture 10 between the flat stationary clamping surface 20 and the flat moving clamping surface 24, with these clamping surfaces 20, 24 spaced apart from this assembly of the members 14. Assembly in the configuration of the gate is understood to mean that the members are positioned relative to one another in the manner of the gate 12 in its finished condition. Preferably, before this assembly process is begun, the members 14 are prefabricated to the extent that they fit together to form a gate having the desired height and width. For example, the assembly of the members in the configuration of the gate 12 is placed on the upward facing support surfaces 186 and 49 of the stationary clamping structure 18 and the moving clamping structure 22, respectively.

In the exemplary gate 12 of the figures, the assembly of members 14 in the configuration of the gate 12 is formed, for example, by first inserting one end of each of the slats 174 forming the panel 176 into the slat-receiving trough 178 of one of the rails 162. Then, the slat-receiving trough 178 of the other rail 162 is slid into place over the other ends of these slats 174. Next, the channels 180 are installed along the edges of the outermost slats 174. Then, the outward-extending ends of the rails 162 are inserted within the four apertures 166 in the posts 160, and the four collars 170 are inserted within the ends of the posts 160 over the ends of the rails 162. Some or all of the process of forming the assembled configuration of the gate 12, as described above, can be performed with members 14 resting on the support surfaces 49, 186 of the clamping fixture 10. In any case, when the assembled configuration is formed, it is placed or left to rest on these support surfaces 49, 186, with the ends of posts 160 on one side of the gate 12 against the flat stationary guiding surface 190, and with the moving support structure 22 in its open position.

The preferred method for assembling the gate 12 additionally includes a second step of driving the flat moving clamping surface 24 toward the flat stationary clamping surface 20 to clamp the assembly of the members 14 between the clamping surfaces 24 and 20. This is done, for example, by manually moving the handle 90 of the valve 70 so that a fluid connection is established between the source of compressed air through air line 71 and the first end 42 of the chamber 40 within each of the pneumatic cylinders 32, while the second end 44 of these chambers is exhausted to the atmosphere.

This preferred method of assembling the gate 12 further includes a third step of exerting a clamping force on the assembly of members 14 between the flat moving clamping surface 24 and the flat stationary clamping surface 20 during the attachment of certain of the members 14 to one another.

This clamping force is retained by leaving the valve handle 90 in the position causing a fluid connection to be made between the first end 44 of the chamber 42 within each pneumatic cylinder 32. This attachment process may include partially curing an adhesive placed between certain of the members 14 during the assembly of these members 14 into the configuration of the gate 12. For example, at least the process of inserting the collars 170 is preceded or accompanied by applying an adhesive for holding the collars in place within the posts 160 and for holding the ends of the rails 162 in place within the collars 170. This attachment process may additionally or alternatively include the attachment of certain members 14 by means of mechanical fasteners. For example, the ends of the rails 162 are fastened in place within the collars 170 by drilling holes and installing screws 172.

The preferred method of assembling the gate 12 also includes a fourth step of moving the flat moving clamping surface 24 away from the stationary clamping surface 20 to release the members 14 assembled into the gate 12. This is done, for example, by manually moving the handle 90 of the valve 70 so that a fluid connection is established between the source of compressed air through air line 71 and the second end 44 of the chamber 40 within each of the pneumatic cylinders 32, while the first end 42 of these chambers is exhausted to the atmosphere.

The preferred method of assembling the gate 12 also includes a fifth step of removing the members 14 assembled in the configuration of the gate 12 from the clamping fixture 10.

The processes of clamping and releasing the members 14 assembled in the configuration of the gate 12 is carried out using a portion of the relatively short motion of the moving clamping structure 22 through the operation of the pneumatic cylinders 32. For example, the pneumatic cylinders 32 are configured to move the moving clamping structure 22 through a distance of 15.24 cm (6 inches). For the clamping force to be maintained, the members 14 must be clamped before a limit of movement of the moving clamping structure 22 in the clamping direction of arrow 28 is reached. On the other hand, the clamping fixture 10 is preferably provided with an ability to be used in the assembly of various widths of gates, with the allowable variations in the width of the gate being substantially larger than the distance through which the pneumatic cylinders 32 can move the moving clamping structure 22. This ability is provided by mounting the actuator 26 to slide on the stationary frame 16. The steps described above in the preferred method for assembling the gate 12 may then be preceded by moving the actuator 26 on the stationary frame 16 relative to the flat stationary clamping surface 20 to prepare the clamping fixture 10 for the assembly of a gate 12 having a width determined by the members 14. This is done, for example, by removing the attachment fasteners 150, by sliding the actuator 26 in or opposite the direction of arrow 28, and by installing the attachment fasteners in different attachment holes 152.

While the invention has been described in its preferred versions or embodiments with some degree of particularity, it is understood that this description has been given only by way of example, and that many variations can be made without departing from the spirit and scope of the invention.

What is claimed is:

1. A method for assembling a gate from a plurality of members, wherein said method comprises:

a) forming an assembly of said members in a configuration of said gate, to rest in a clamping fixture between a fiat stationary clamping surface and a flat moving clamping surface, wherein said damping surfaces are disposed parallel to one another and spaced apart from said assembly of said members, and wherein said assembly of said members includes an adhesive between adjacent members in said plurality of members;

b) driving said flat moving clamping surface toward said flat stationary clamping surface to clamp said assembly of said members between said flat moving clamping surface and said stationary clamping surface;

c) exerting a clamping force on said assembly of said members between said moving clamping surface and said stationary clamping surface during attachment of members within said plurality of members to one another while said adhesive is partly cured;

d) moving said flat moving clamping surface away from said flat stationary clamping surface; and e) removing said assembly of said members from said clamping fixture.

2. The method of claim 1, wherein certain members within said plurality of members are attached to one another with mechanical fasteners during step c).

3. The method of claim 1, wherein certain members within said plurality of members are attached to one another by inserting screws into the certain members during step c).

4. The method of claim 1, wherein said flat moving clamping surface is slidably mounted on an actuator moving said flat moving clamping surface toward said flat stationary clamping surface, and step a) is preceded by moving said actuator on a stationary frame relative to said flat stationary clamping surface to prepare said clamping fixture for the assembly of a gate having a width determined by said members.

5. The method of claim 1, wherein said assembly of said members is additionally placed against a flat stationary guiding surface, perpendicular to said flat stationary clamping surface, extending toward said moving clamping surface.

6. The method of claim 1, wherein step b) includes moving a valve structure to establish a fluid connection between a first end of chamber within a pneumatic cylinder attached to said flat moving clamping surface, compressed air within said first end of said chamber causes said flat moving clamping structure to move toward said flat stationary clamping surface in step b) and to exert said clamping force on said assembly of said members in step c), and step d) includes moving said valve structure to exhaust said first end of said chamber.

7. The method of claim 6, wherein moving said valve structure in step b) additionally causes a second end of said chamber to be exhausted, moving said valve structure in step d) additionally establishes a fluid connection between said second end of said chamber and said source of compressed air, and compressed air within said second end of said chamber with said first end of said chamber exhausted causes said flat moving clamping structure to move away from said flat stationary clamping surface in step d).

8. The method of claim 1, wherein said assembly of said members is additionally placed against a flat moving support surface, perpendicular to said flat moving clamping surface and moving with said flat moving clamping surface, extending toward said stationary clamping surface.

9. A method for assembling a gate from a plurality of members, wherein said method comprises:

a) forming an assembly of said members in a configuration of said gate, to rest in a clamping fixture between a flat stationary clamping surface and a flat moving clamping surface, wherein said clamping surfaces are disposed parallel to one another and spaced apart from said assembly of said members;

b) driving said flat moving clamping surface toward said flat stationary clamping surface to clamp said assembly of said members between said flat moving clamping surface and said stationary clamping surface;

c) exerting a clamping force on said assembly of said members between said moving clamping surface and said stationary clamping surface during attachment of members within said plurality of members to one another by inserting screws into said members;

d) moving said flat moving clamping surface away from said flat stationary clamping surface; and e) removing said assembly of said members from said clamping fixture.

10. The method of claim 9, wherein said assembly of said members is additionally placed against a flat stationary guiding surface, perpendicular to said flat stationary clamping surface, extending toward said moving clamping surface.

11. The method of claim 9, wherein said assembly of said members is additionally placed against a flat moving support surface, perpendicular to said flat moving clamping surface and moving with said flat moving clamping surface, extending toward said stationary clamping surface.

* * * * *